US011504934B2

(12) United States Patent
Klaer et al.

(10) Patent No.: US 11,504,934 B2
(45) Date of Patent: Nov. 22, 2022

(54) MODULAR FILLING SHOE FOR A ROTARY PRESS

(71) Applicant: Korsch AG, Berlin (DE)

(72) Inventors: Ingo Klaer, Berlin (DE); Stephan Mies, Berlin (DE); Robert Peucker, Berlin (DE)

(73) Assignee: Korsch AG, Berlin (DE)

( * ) Notice: Subject to any disclaimer, the term of this patent is extended or adjusted under 35 U.S.C. 154(b) by 383 days.

(21) Appl. No.: 16/615,472

(22) PCT Filed: May 24, 2018

(86) PCT No.: PCT/EP2018/063653

§ 371 (c)(1),
(2) Date: Nov. 21, 2019

(87) PCT Pub. No.: WO2018/215594

PCT Pub. Date: Nov. 29, 2018

(65) Prior Publication Data

US 2021/0170710 A1 Jun. 10, 2021

(30) Foreign Application Priority Data

May 24, 2017 (EP) ..... 17172619

(51) Int. Cl.
*B30B 15/30* (2006.01)
*B30B 11/08* (2006.01)

(52) U.S. Cl.
CPC ..... *B30B 15/304* (2013.01); *B30B 11/08* (2013.01)

(58) Field of Classification Search
CPC ..... B30B 15/304
See application file for complete search history.

(56) References Cited

FOREIGN PATENT DOCUMENTS

| | | |
|---|---|---|
| DE | 20 2007 002707 U1 | 7/2008 |
| EP | 2 551 099 A2 | 1/2013 |
| FR | 1 334 257 A2 | 8/1963 |

OTHER PUBLICATIONS

International Search Report and Written Opinion for International Application No. PCT/EP2018/063653, dated Aug. 21, 2018.

(Continued)

*Primary Examiner* — Yung-Sheng M Tsui
*Assistant Examiner* — Melody Tsui
(74) *Attorney, Agent, or Firm* — Wolf, Greenfield & Sacks, P.C.

(57) ABSTRACT

The invention relates to an impeller filling shoe for material feed to die bores of a rotary press, which is built-up modularly in order to enable a change in function between a 2-chamber filling shoe comprising a filling vaned wheel and a proportioning vaned wheel, and a 3-chamber filling shoe comprising a filling vaned wheel, a proportioning vaned wheel and a feeding vaned wheel, wherein the impeller filling shoe does not comprise a gearbox for driving the vaned wheels. Furthermore, the invention relates to a rotary press comprising the modular impeller filling shoe, whereby the gearbox for driving the vaned wheels is located outside the impeller filling shoe. The invention relates in addition to the use of the impeller filling shoe according to the invention in methods for converting the modular impeller filling shoe from a 2-chamber filling shoe to a 3-chamber filling shoe and vice versa. The functional conversion of the impeller filling shoe can take place both outside the tablet press as well as in the mounted state inside the tablet press.

15 Claims, 16 Drawing Sheets

(56) References Cited

OTHER PUBLICATIONS

International Preliminary Report on Patentability for International Application No. PCT/EP2018/063653, dated Dec. 5, 2019.

MODULAR FILLING SHOE FOR A ROTARY PRESS

RELATED APPLICATIONS

This application is a national stage filing under 35 U.S.C. § 371 of international application number PCT/EP2018/063653, filed May 24, 2018, which claims the benefit of European application number EP 17172619.3, filed May 24, 2017, each of which is herein incorporated by reference in its entirety.

The invention relates to an impeller filling shoe for material feed to die bores of a rotary press, which is built-up modularly in order to enable a change in function between a 2-chamber filling shoe comprising a filling vaned wheel and a proportioning vaned wheel, and a 3-chamber filling shoe comprising a filling vaned wheel, a proportioning vaned wheel and a feeding vaned wheel, wherein the impeller filling shoe does not comprise a gearbox for driving the vaned wheels. Furthermore, the invention relates to a rotary press comprising the modular impeller filling shoe, whereby the gearbox for driving the vaned wheels is located outside the impeller filling shoe. The invention relates in addition to the use of the impeller filling shoe according to the invention in methods for converting the modular impeller filling shoe from a 2-chamber filling shoe to a 3-chamber filling shoe and vice versa. The functional conversion of the impeller filling shoe can take place both outside the tablet press as well as in the mounted state inside the tablet press.

BACKGROUND AND STATE OF THE ART

The invention relates to the field of rotary presses, which are used in the pharmaceutical, technical or chemical industry or in the food industry to produce tablets or pellets in large quantities from powdery materials. Rotary presses are well known in the state of the art. These are characterized by a rotor comprising an upper and lower punch guide for receiving punches and a die plate with dies with bores for receiving the powdery material. After filling the die bores, the material can be pressed into a pellet or a tablet through the interaction of upper and lower punches.

Various state-of-the-art filling devices are used to fill the die bores. A so-called gravimetric chamber-filling shoe is characterized by an open frame in which baffles and barrages are located. With a gravimetric chamber-filling shoe, the introduced press material is driven by the friction to the die plate, by means of the baffles it is guided over the die bores and falls by gravity alone into the die bores that pass underneath the frame. Due to the gravimetric filling no simple and fast adaptation to different flow velocities of the powder can take place. This is one of the reasons why gravimetric chamber filling shoes are hardly used in the pharmaceutical sector today, but instead impeller filling shoes are used.

Impeller filling shoes are motor-driven filling devices in which the material is fed from above. For this purpose, a material container can be located above the filling shoe, on the head piece of the rotary press, which continuously fills the impeller filling shoe with powder via a material inlet. In the impeller filling shoe there are usually one, two or three vaned wheels which transport the powder material from the material inlet by a rotary movement to a filling opening in the filling shoe base plate above the pitch circle of the die bores through which the powder enters the bores. This allows a more uniform and precise filling of the die bores.

The initially developed impeller filling shoes were driven directly by the rotating rotor of the tablet press using a gear rim and gear drive. The filling result was already significantly better with difficult press compounds than with the use of a chamber filling shoe. However, the direct drive of the vaned wheels by the rotor turned out to be a disadvantage, as the filling wheels rotated correspondingly slower at a slower rotor speed and faster filling was only possible by increasing the rotor speed. An individual setting of different speeds for the rotor and the vaned wheels depending on the filling and flow behaviour of the press material was therefore not possible, which turned out to be a disadvantage.

A more significant improvement with regard to the filling of the die bores in rotary presses was only achieved when the direct drive of the impellers was carried out by an infinitely variable separate motor. Now it was possible to set the optimum speed of the vaned wheels to the rotor speed depending on the press material, the rotor speed and the tablet weight, so that excellent tablets with constant weight within the permissible tolerances could be produced with the smallest relative standard deviations.

In the state of the art it is known to design impeller filling shoes with one, two or three stirrer blades. Such impeller filling shoes are disclosed for instance in the patent application FR 1 334 257 A, EP 2551 099 A2 or DE 20 2007 002707 U1.

Filling devices with two vaned wheels—one filling vaned wheel and one proportioning vaned wheel—have become a widespread standard. These impeller filling shoes are also referred to as 2-chamber filling shoes.

2-chamber filling shoes are generally designed as follows: In a bottom part of the filling shoe there are circular cut-outs on the upper side for the filling vaned wheel, which is placed on the left, and a proportioning vaned wheel, which is placed on the right. The direction information is based on the mounted filling shoe, whereby a viewing direction directed towards the rotor centre is assumed. In the bottom part of the filling shoe, at the level of the pitch circle of the bores in the die plate, there is still an opening in the bottom area, which is referred to as the material outlet or filling opening. Usually an intermediate plate covers the upper side of the bottom part of the filling shoe. It contains the two openings for the drive shafts of the two vaned wheels and the opening for the material feed. A filling shoe cover rests on the intermediate plate and contains the material inlet, the gear for the drive of the two vaned wheels and the drive pin for the gear drive. In the state of the art, the vaned wheels are driven from both sides, from the upper side and from the lower side of the filling shoe housing. In 95% of all rotary presses, however, the impeller filling shoes are driven from the top, i.e. the drive motor is located in the head piece of the rotary press. The drive motor is connected to the gearbox of the impeller filling shoe via a corresponding drive shaft from above.

The filling vaned wheel usually rotates clockwise (looking at the rotary press from above), the proportioning vaned wheel counterclockwise. Thus, the filling vaned wheel rotates in the same direction as the pitch circle of the dies at the point of intersection. The pressing material is transferred by the filling vaned wheel from the left side into the filling opening of the filling shoe base plate and from there reaches the centre of the filling opening in the individual die bores. In this area, the exchangeable filling curve is located in the lower curve sequence, which withdraws the lower punch under the die surface, for example, in a range of 6-22 mm. The press material is thus sucked into the die bore over the withdrawal area of the filling curve. Usually, the selected filling curve always fills more press material into the die bore than would be necessary for the desired tablet weight. This is also referred to as the gross filling. The proportioning unit is located below the second, right half of the filling device in the lower curve sequence. It usually consists of a height-adjustable proportioning unit with the catch and withdrawal curves and a movable or rigid transfer rail arranged between the filling curve and the proportioning unit. If, for example, a 10 mm filling curve is used in the rotary press and a net filling of 6 mm is required for the tablet weight, the lower punches are raised by 4 mm by the proportioning unit after the filling process so that a filling volume of 6 mm remains in the die bores. This filling is respectively referred to as net filling. The 4 mm of press material proportioned out by the proportioning unit is pushed back by the lower punches via the second half of the filling device into the filling opening and thus into the right chamber of the impeller filling shoe. In this right chamber there is the so-called proportioning vaned wheel, which rotates counterclockwise and thus transports excess material in the direction of the left filling vaned wheel. The excess press material is returned via appropriate guide rails to the left filling chamber where it is used proportionally by the filling vaned wheel for a new filling.

With normal granulates and direct mixes, a good tableting result can already be achieved with a 2-chamber filling device. However, there are also compounds with extremely fast flow characteristics, so that the material pressure exerted by the material column from the material outlet of the feed container to the filling vaned wheel has a strong influence on the die filling. Depending on the position of the material container above the rotary press, which according to the state of the art is usually located at a height between 2.5-6 m, the tablet weight may vary considerably. This means that a high material column results in a higher tablet weight and a low material column results in a lower tablet weight. In order to eliminate this influence of the material column height on the end product, a state-of-the-art 3-chamber filling shoe was developed.

With a 3-chamber filling shoe, there is an additional third chamber above the filling and proportioning vaned wheels, in which a third vaned wheel is placed. The third vaned wheel is also referred to as feeding vaned wheel.

The direction of rotation of the feeding vaned wheel is of no decisive importance and is therefore used differently in the state of the art. However, it is important to note that the material inlet to the feeding vaned wheel is offset in a different position than the material outlet to the lower chamber of the filling shoe. Preferably, the material inlet is on an inner pitch circle and the outlet opening for the powdery material is on an outer pitch circle. This creates a further Z-stage for the transport of the powder into the filling shoe housing, which prevents extremely well flowing press masses from simply rushing through the filling device after opening the main valve.

In the case of a 3-chamber filling shoe, the press material is first fed into the feeding chamber, comprising the feeding vaned wheel. From there, by rotating the feeding vaned wheel, it is transported to the chamber of the filling vaned wheel in a plane that is located underneath, which is preferably located on an outer pitch circle. This causes the material to fall from the feeding chamber into the filling chamber, from where it is taken by the filling vaned wheel and brought to the die pitch circle, from where it falls through a filling opening in the bottom part of the filling shoe into the die bores. The feeding vaned wheel thus assumes the function of a cellular wheel sluice, which permanently transports the same amount of material into the filling chamber regardless of the pressure of the material column. By adding the third chamber, an excellent tableting result can be achieved regardless of the flow behaviour of the press material.

The basic design of the 3-chamber filling device corresponds to that of the 2-chamber filling device, only that above the filling and proportioning vaned wheel there is a further chamber for the feeding vaned wheel.

In order to be able to drive the vaned wheels in a defined direction of rotation with a motor even in the case of a 3-chamber filling shoe, the state of the art filling device usually has a corresponding gearbox with a drive shaft and the connections for the three vaned wheels on the housing cover of the filling device.

Excellent filling results can be achieved with a universal 3-chamber impeller filling shoe. In particular, the influence on the tablet weight by a different material column above the material inlet can be minimized by designs with two Z-stages from the material inlet to the filling vaned wheel and from the filling vaned wheel to the filling opening. This advantage, however, faces a considerable disadvantage in the state of the art. A 3-chamber impeller filling shoe made from V4A steel weighs more than 50 kg in the state of the art. The removal of a 3-chamber filling shoe is very difficult due to its high weight.

Furthermore, state-of-the-art technology may prefer to use a 2-chamber filling shoe for powder materials with a lower flow behaviour. In contrast to a 3-chamber filling shoe, this would reduce energy consumption. Due to the different material filling of tablet presses, it would therefore be desirable to provide a filling shoe which, on the one hand, has a particularly high adaptability to the different flow behaviour of the powder material and, on the other hand, is characterized by a low dead weight and easy removal, for example for cleaning.

SUMMARY OF THE INVENTION

The invention is therefore based on the objective of eliminating the disadvantages of the state of the art and providing a filling shoe, which is characterized by a high adaptability to the flow behaviour of the powder material and a simple exchangeability.

This objective is accomplished according to the present invention by the independent claims. The dependent claims represent preferred embodiments of the device and methods according to the invention.

In a preferred embodiment the invention relates to an impeller filling shoe for material feed to die bores of a rotary press, wherein the impeller filling shoe is built-up modularly in order to enable a change in function between a 2-chamber filling shoe comprising a filling vaned wheel and a proportioning vaned wheel, and a 3-chamber filling shoe comprising a feeding vaned wheel, a filling vaned wheel and a proportioning vaned wheel and wherein the impeller filling shoe itself does not comprise a gearbox for driving the vaned wheels.

The invention relates to an impeller filling shoe of the type described above and is suitable for filling die holes in tablet presses with powdery material. According to the invention, the impeller filling shoe has a modular design. In the sense of the invention, the modular impeller filling shoe is preferably understood to consist of at least three different assemblies which can be assembled in at least two configurations to perform at least two functions.

According to the invention, the impeller filling shoe is preferably available in an initial configuration as a 2-chamber impeller filling shoe. In this configuration, the impeller filling shoe has a filling vaned wheel in a first chamber and a proportioning vaned wheel in a second chamber. As described for state of the art 2-chamber filling shoes, the material is fed preferably from a material reservoir from above or via a material inlet initially into the first chamber, comprising the filling vaned wheel.

This chamber is preferably located in the left area of the impeller filling shoe. In the sense of the invention, the directions right and left are preferably defined for the mounted filling shoe from a viewing direction that looks to the rotor center. The left and right indications also apply to the current design of tablet presses, where the die disk rotates counterclockwise when viewed from above. With a reversed direction of rotation, it may also be preferable to reverse the positioning of the chambers of left and right accordingly. Thus, when the die plate is rotated under the filling shoe, the die bores are first guided under the left area of the filling shoe base plate of the impeller filling shoe. In it, the filling vaned wheel is located, which preferably transports the powdery material to a so-called filling opening of the impeller filling shoe. In the sense of the invention, the filling opening preferentially means a recess or an opening in the underside of the filling shoe which allows a connection between the first and/or second chamber to the die plate comprising the die bores. The filling opening is therefore also referred to as material outlet.

With the help of the filling shoe, the filling process can preferably be carried out as is sufficiently well known in the state of the art. For this purpose, the lower punches are preferably withdrawn while the die holes are located under the filling opening. Thus, the powdery material in the first chamber can completely fill the die bores by gravity. In this first step, preferably more press material is introduced into the die bore than would be necessary for the desired tablet weight. This so-called gross filling is then brought to the desired tablet weight or net weight by a proportioning unit. For this purpose, the lower punches are raised again in order to eject excess material. The excess powder material can preferably be fed through the filling opening into the second (right) chamber of the impeller filling shoe. Ejection and proportioning are carried out preferentially for this purpose, while the die bores are still below the second chamber. This enables reuse of the excess powder material, which is transported from the second (right) chamber back to the first (left) chamber by the proportioning vaned wheel.

In accordance with the invention, the modular design of the impeller filling shoe allows it to be assembled in at least a second configuration. In the second configuration, the impeller filling shoe is available as a 3-chamber filling shoe. In the configuration as a 3-chamber filling shoe, the impeller filling shoe also has a third vaned wheel in addition to the filling vaned wheel and the proportioning vaned wheel, which is referred to as the feeding vaned wheel. For this purpose, for example, the modular impeller filler shoe can comprise a first assembly in which the filling vaned wheel is installed in a first (left) chamber and the proportioning vaned wheel in a second (right) chamber. For the configuration of the 2-chamber filling shoe, for example, a second assembly can be mounted on the first assembly, which comprises a material inlet aligned to the filling vaned wheel. To switch from the 2-chamber configuration to the 3-chamber configuration, for example, the second assembly could be replaced with a third assembly comprising a feeding vaned wheel. Preferably, the third assembly also includes a material inlet, which is aligned with the feeding vaned wheel. In addition to this described modular exchange of assemblies, other variants are also included as long as they allow a change of the configuration of the modular impeller filling shoe from a 2-chamber to a 3-chamber filling shoe.

The inventive modular design of the impeller filling shoe makes it surprisingly easy to switch between the two configurations of impeller filling shoes mentioned above. This allows for an especially flexible adjustment to different process conditions. In order to precisely control the weight in the end product of the tablet, it is essential to ensure exact filling of the die bores using the filling shoes. For certain applications, for example with fast flowing powder material, it can be advantageous to use a 3-chamber filling shoe. The preferred double Z-stage guidance of the powder material enables the powder flow to be slowed down in a particularly controllable way. However, it may also be preferable to use a 2-chamber filling shoe for other press materials. Compared to the 3-chamber filling shoe, it is characterized by lower energy consumption, lower weight and easier controllability.

The inventive modular design puts the user in the comfortable position to adapt the configuration of the filling shoe to the corresponding operating conditions by means of quick and easy handling.

However, the impeller filling shoe according to the invention achieves its particularly surprising technical effect only by combining the modular design with the design condition that the impeller filling shoe itself does not include a gear for driving vaned wheels. In the sense of the invention, this feature is preferably understood to mean that the gearbox for driving the vaned wheels as such does not belong to the impeller filling shoe. To remove the impeller filling shoe, e.g. for cleaning and/or changing the configuration, it is not necessary to remove the gearbox as well. The gear is functionally connected to the impeller filling shoe during operation, but does not belong to the impeller filling shoe. Preferably, the gearbox is instead located in a position within the tablet press that is further away from the impeller filling shoe. The position within the tablet press can be freely selected because the gearbox does not belong to the impeller filling shoe. For example, the gearbox can be located in a lower separate machine bed.

As already explained at the beginning, the gearboxes for driving the filling vaned wheels are characterized by a high weight. In the case of state-of-the-art impeller filling shoes, the gearbox is usually installed as a component of the impeller filling shoe together with the latter, so that when the impeller filling shoe is removed, for example for cleaning, the heavy gearbox must also be removed. A state-of-the-art 3-chamber filling shoe often weighs far more than 50 kg. Disassembly must therefore be carried out by at least two persons. Also, disassembling these heavy elements may pose an increased health risk to certain groups of people with back problems. The total weight of an impeller filling shoe could already be reduced by designing an impeller filling shoe without the gearbox. By combining a modular design with a gearbox-less design, the weight of the assemblies to be assembled or disassembled is considerably reduced. Furthermore, it may also be preferred that, for example, a basic assembly of the impeller filling shoe, which can remain mounted both in the configuration of the 2-chamber filling shoe and in the configuration of the 3-chamber filling shoe in the tablet press, while the functional change between the configurations takes place by exchanging the other assemblies.

Such a modular design of a gearbox-less filling shoe represents a complex sequence of constructive steps, which for the expert do not result from the known state of the art in an obvious way. Rather, it is surprising that the combination of a modular design with the absence of a gearbox is possible in a simple manner and provides the above-mentioned special advantages for flexible functionality and easier replacement.

In a preferred embodiment of the invention, the impeller filling shoe is characterized by the fact that the vaned wheels each have an adaptor for attaching a drive shaft for connection to an external gearbox. In the case of the 2-chamber filling shoe, the vaned wheels refer preferably to the filling vaned wheel and the proportioning vaned wheel, while in the case of the 3-chamber filling shoe the filling vaned wheel, the proportioning vaned wheel and the feeding vaned wheel are preferably referred to. By providing adaptors for connecting the drive shafts, a particularly fast and yet safe connection can be provided between the gearbox and the vaned wheels of the filling shoe. Surprisingly, pluggable drive shafts have proven to be particularly reliable for this purpose. The drive shafts transmit the rotational movement of the gearbox to a rotation of the vaned wheels. Various embodiments are possible for the design of the adaptors. Thus, the drive shaft can be connected to the vaned wheel through the adaptor by screwing it in, locking it in, clamping it in or by other means, but can be released by means of specific handles. It may be preferable that each adaptor fits each drive shaft. However, it can also be preferred that the plug-in principle is coded so that one adaptor can be assigned to one drive shaft respectively. If coding is also carried out on the gearbox side, incorrect assembly is particularly easy to avoid.

In a preferred embodiment of the invention the impeller filling shoe is characterized in that it comprises a base module in which a filling vaned wheel is present in a first left chamber and a proportioning vaned wheel is present in a second right chamber, the 2-chamber filling shoe having a first modular build-up which can be mounted on the base module and has a first material inlet, which in the mounted state is located above the filling vaned wheel and the 3-chamber filling shoe has a second modular build-up in which a feeding vaned wheel is present in a third central chamber, the second modular build-up can be mounted on the base module and has a second material inlet. In the sense of the invention, the 2-chamber or 3-chamber filling shoe preferably designates the configuration of the modular impeller filling shoe according to the invention as a 2-chamber or 3-chamber filling shoe.

The base module preferably refers to an assembly of the impeller filling shoe, which is used both in the configuration of the 2-chamber and the 3-chamber filling shoe. When there is a functional change between these configurations, the base module is not replaced, but extended by different modules. It is preferred that in the base module the filling vaned wheel is located in a first (left) chamber and the proportioning vaned wheel in a second (right) chamber. The base module can consist of two or more assemblies in a preferred variant. For example, the base module can include a filling shoe base plate in which the filling opening is located on the underside. This coincides preferably with the left and right chamber of the filling shoe in order to allow filling and proportioning of the die bores. The filling vaned wheel and the dosing vaned wheel are preferably installed in the base plate, whereby the base module can also preferably include a filling shoe cover which covers the vaned wheels.

In case a filling shoe cover is provided, the base module preferably has mounting options on the upper side for at least two different modular build-ups.

Preferably, a first modular build-up can provided for the configuration as 2-chamber filling shoe. The first modular build-up has preferably a first material inlet for this purpose, whereby the modular build-up is mounted in such a way that the material inlet is located above the first chamber, comprising the filling vaned wheel. For this purpose, it is preferred that a defined positioning of the first modular build-up is defined on the base module, for example in the form of bores. This allows a repeatable and reliable assembly of the first modular build-up for the 2-chamber filling shoe.

In addition to a second material inlet, the second modular build-up preferably also includes a third middle chamber into which a feeding vaned wheel can be inserted or is inserted. The second modular build-up is therefore suitable for changing to a 3-chamber filling shoe. As in the case of the first modular build-up, the second modular build-up can preferably be fastened to the top of the base module using fasteners. In the case of a filling shoe cover, for example, there may be separate bores which define the positioning of the second modular build-up. It can also be preferred, however, that some bores can be used for both the first and the second modular build-up. It is also preferred that in the second modular build-up the feeding vaned wheel is located below the second material inlet. In order to optimize the material flow, the second modular build-up is preferably installed on the base module in such a way that the feeding vaned wheel is positioned centrally above the filling vaned wheel and proportioning vaned wheel. When the material is filled into the 3-chamber filling shoe, the powder is thus conveyed from the feeding vaned wheel in a first stage to the filling vaned wheel and in a second stage from the filling vaned wheel to the filling opening. As described at the beginning, the addition of an additional vaned wheel can ensure a particularly uniform powder supply, which can lead to excellent tableting results.

Furthermore, it can be preferred for the first and the second modular build-ups to each consist of a plurality of components. For example, the modular build-ups can comprise an intermediate plate, on which the material inlet can be mounted. In another variant, the same material inlet can also be used for both the configuration of the 2-chamber filling shoe and the 3-chamber filling shoe. This would only require an additional step of converting the material inlet from a first intermediate plate to a second intermediate plate.

The provision of the base module allows a particularly simple conversion from a 2-chamber filling shoe to a 3-chamber filling shoe by exchanging the first modular build-up by the second modular build-up. The described modular build-up of this preferred version therefore represents a particularly compact and technically robust solution. The effective use of the base module in both configurations also reduces manufacturing costs. For example, conventional versions of providing two separate filling shoes require five vaned wheels, while the preferred modular impeller filling shoe requires only three vaned wheels, which can be used in two modular configurations.

In another preferred embodiment of the invention, the impeller filling shoe is characterized in that the individual assembly components of the modular impeller filling shoe weigh not more than 20 kg, preferably not more than 15 kg. Due to the modular design of the gearbox-less impeller filling shoe, it is advantageously possible to keep the individual weight of the individual assembly components of the impeller filling shoe below 20 kg and even below 15 kg. The assembly components preferably refer to those assemblies of the impeller filling shoe which have to be installed or removed as a whole during assembly or disassembly of the filling shoe. Such a low weight for the assembly components is not known in the state of the art, in particular for a 3-chamber filling shoe, and is particularly advantageous with regard to user-friendliness and occupational safety. According to the current state of knowledge, for example, assembly components weighing less than 15 kg can be transported and replaced by female personnel without health concerns.

In another preferred Embodiment of the invention, in the configuration as a 2-chamber filling shoe, press material is guided from the first material inlet to the filling opening and the die bores in one Z-stage, and in the 3-chamber filling shoe, press material is guided from the second material inlet to the filling opening and the die bores in two Z-stages. In the sense of the invention, a Z-stage preferentially denotes a step, which is characterized by a plane or step, so the powdery material does not flow down in a straight flow along the gravitational line, but is first stopped at the plane or step. The material is then transported from the step to a material outlet such as the filling opening or another step.

In the design of the modular impeller filling shoe, the Z-stages are preferably achieved by the relative positioning of the chambers. It is preferred that for the 2-chamber filling shoe the material inlet for the powder is not positioned in a plumb line above the centre of the filling opening, but that the material is first fed from the material inlet into the first (left) chamber, where the powder flow is stopped at a first step or plane. With the aid of the filling vaned wheel, the powder is transported from the plane further to the filling opening, so that the die bore underneath can be filled. This constitutes a first Z-stage.

In the 3-chamber filling shoe, the material inlet is preferably positioned in such a way that the powdery material is first guided to a first step or plane in the third chamber. From here, the powdery material is transported by the feeding vaned wheel to the first (left) chamber below, in which the filling vaned wheel is located. From there, as in the case of the 2-chamber filling shoe, the transport takes place in a further Z-stage to the filling opening. By providing a feeding vaned wheel, a second Z-stage in the case of a 3-chamber filling shoe can thus be achieved. In this preferred embodiment a particularly precise control and proportioning of the filling material is possible. The design of the filling shoes by means of specific Z-stages effectively prevents powdery material from rushing through. In addition, the Z-stages reduce the back pressure on the material, which is intermediately stored in the intermediate levels in the individual chambers in a free way. By separating the powder material from the feed material column, a particularly homogeneous filling of the die bore can be ensured and clumping can be avoided. Thus, excellent tableting results can be achieved with the preferred impeller filling shoes.

In a further preferred embodiment of the invention, the impeller filling shoe is characterized in that the base module has a filling opening on the underside which is equipped on both sides with resilient, exchangeable sandwich sealings and/or the impeller filling shoe has a resilient pressure piece along the rotation at the end of the filling opening in order to reduce material loss.

The seals attached to the edges of the filling opening of the base module allow a particularly closed filling compartment to be achieved. The resilient pressure piece and the resilient, exchangeable sandwich seal prevent material loss. For example, the seals prevent the powder material on the surface of the die plate next to the die bores from rotating out of the area of the filling shoe. In addition to the effective use of the powder material, the preferred embodiment allows a particularly pure production of the tablets. The particularly reliable limitation of the powdery material to the area of the filling shoe is of particular importance if different filling stations with different materials are working on a die plate, for example for the production of multilayer tablets. Due to the resilient, exchangeable sandwich seal and the resilient pressure pieces, a particularly effective and reliable filling station can be implemented with minimal material carry-over.

In another preferred embodiment of the invention, the impeller filling shoe is characterized in that the components of the impeller filling shoe comprise materials which are preferably selected from the group comprising stainless steel, aluminium and/or plastic. The materials mentioned are characterized by a particularly low weight in combination with a high durability. Surprisingly, the production of the aluminium and plastic components for the filling shoe not only resulted in a significant weight reduction, but also improved functional stability. In the state of the art, VA steel is preferably used for filling shoes. It was therefore surprising that a filling shoe could also be made from materials such as plastic and aluminium, which meet the highest demands for precision, low wear and tear and low susceptibility to error.

In another preferred embodiment, the invention relates to a rotary press, characterized in that the rotary press has a gearbox for driving the vaned wheels which is located outside the impeller filling shoe and the vaned wheels can be connected to the gearbox by means of pluggable drive shafts. The rotary press according to the invention belongs to the category of rotary presses as described above and is sufficiently known in the state of the art. The rotary press is therefore characterized by a rotor comprising an upper and lower punch guide for receiving punches and a die plate with bores for receiving the powdery material. After filling the die bores by the impeller filling shoe according to the invention, the material can be pressed into a pellet or a tablet through the interaction of upper and lower punches. The rotary press thus comprises a modular impeller filling shoe according to the invention or preferred embodiments thereof for material filling of the die bores. Advantages, which are revealed for preferred embodiments of the impeller filling shoe, also have an advantageous technical effect when used in the rotary press according to the invention. The gearbox, which is used to drive the impellers of the filling shoe, is not located in the impeller filling shoe, but is located outside the impeller filling shoe in a separate assembly of the tablet press that is separate from the impeller filling shoe. To operate the impeller filling shoe, the vaned wheels are connected to the gear by pluggable drive shafts. The gearbox is therefore also referred to as an external gearbox, i.e. a gearbox located outside the impeller filling shoe.

In a preferred embodiment of the invention, the rotary press is characterized by the fact that the gearbox for driving the vaned wheels is located below the impeller filling shoe, preferably on the underside of a vibration-decoupled carrier plate of the rotary press. In the sense of the invention, the carrier plate preferably refers to the component on which the rotor and the processing stations such as a filling station, a proportioning station or a pressing station are installed. On the upper side of the carrier plate there are therefore preferably the rotor, the rotor drive axis, the upper and lower control curves for the pressing tools, the filling device, the pre- and main printing columns, the tablet stripper, the tablet discharge chute, while below the carrier plate there are the drive gearbox with motor for the rotor drive, the drive with gearbox for the filling device(s). The carrier plate is particularly preferred to be mounted vibration-decoupled, e.g. on four steel or air springs in the machine base. This mounting of the carrier plate means that no vibrations or oscillations are transmitted to the machine housing, which means that the presses have an extremely low noise level and are therefore characterized by quiet operation.

By attaching the gearbox to the underside of the vibration-decoupled carrier plate, a particularly compact design of the tablet press is possible. On the other hand, the gearbox can also be used in an open and therefore inexpensive design, as it is mounted outside the pressing zone and thus protected from dust and dirt.

In a further preferred embodiment, the rotary press is characterized in that the rotary press has in a head portion above the filling shoe a material supply device comprising an outlet tube, the outlet tube being adjustable in at least two positions, such that in the case of a mounted 2-chamber filling shoe the outlet tube is in a first position above the first material inlet of the 2-chamber filling shoe and in the case of a mounted 3-chamber filling shoe the outlet tube is in a second position above the second material inlet of the 3-chamber filling shoe. In this embodiment it is preferred that the rotary press has a head piece which is arranged above the filling shoe. This head piece preferably carries a material feeding device which feeds the powdery material to the filling shoe. Due to the arrangement of the head piece above the filling shoe, gravity can be used advantageously for filling. For this purpose, the head piece above the two material inlets in both versions of the filling device has an opening into which the separate swivelling material feed can be inserted and fastened. The material feed preferably has an outlet tube on its underside, which allows an exact introduction of the press material used into the filling shoe. The filling shoe is mounted in the preferred rotary press in such a way that the outlet tube coincides with the material inlet of the filling shoe.

In a preferred variant of the impeller filling shoe, the material inlet in the case of a 2-chamber filling shoe is not in the same position as in the case of a 3-chamber filling shoe. In the case of the 2-chamber filling shoe, the material inlet is preferably positioned above the filling vaned wheel, i.e. above the first (left) chamber, as described above. In the case of the 3-chamber filling shoe, on the other hand, the material inlet is located above the feeding vaned wheel at a middle position between the first (left) chamber and the second (right) chamber. When the same base module is used, the material inlet in the two configurations is therefore at different positions in the assembled operating state. For this reason, in this preferred version of the rotary press, the head piece is designed in such a way that the outlet tube can be placed in two different positions.

For this purpose, for example, the head piece above the material inlets of the 2- and 3-chamber filling devices can have a circular opening, which is closed from above by the round cover plate when the material feeding unit is mounted, whereby the outlet tube is attached to the round cover plate and can be rotatably fixed in two positions. The angle of rotation preferentially reflects the different local positioning of the material inlet in the two configurations. This design makes it particularly easy to switch between the different configurations of the modular impeller filling shoe within the tablet press. There is no need for time-consuming conversion of the head piece of the tablet press, for example. Instead, the rotating material feeding unit on the head piece of the tablet press can be adapted to the configuration of the filling shoe as a 2-chamber or 3-chamber filling shoe by simple hand movements.

In a further preferred embodiment, the invention also relates to the use of the impeller filling shoe in methods for converting the impeller filling shoe according to the invention or preferred embodiments from a 2-chamber filling shoe to a 3-chamber filling shoe as well vice versa. The conversion can be carried out for the impeller filling shoe both outside the tablet press and inside the tablet press.

A person skilled in the art recognises that preferably in the methods described below for converting the impeller filling shoe according to the invention, the preferred embodiments of the impeller filling shoe described herein are used. Advantageous technical features which have been disclosed for the impeller filling shoe thus convey also an advantageous effect in the uses or methods described herein. For example, it was revealed for the impeller filling shoe that a modular design comprising a base module and a first or second modular build-up allows for a particularly fast conversion. It is apparent that the embodiment also saves time when using the impeller filling shoe in methods. Furthermore, it was disclosed, for example for the impeller filling shoe, that the first and second modular build-up can preferably be mounted with the aid of screws into corresponding bore holes of the base module. The person skilled in the art recognizes that the corresponding assembly steps in the processes can also be implemented preferentially by means of a screw connection in order to enable a quick and precise change.

The methods described below represent preferred uses of the modular impeller filling shoe according to the invention, wherein either the impeller filling shoe is provided in the 2-chamber configuration and converted to a 3-chamber configuration or the impeller filling shoe is provided in the 3-chamber configuration and converted to a 2-chamber configuration.

In a preferred embodiment of the invention, the invention relates a method for converting a 2-chamber filling shoe to a 3-chamber filling shoe comprising the following steps:

a. Providing an impeller filling shoe according to the invention or preferred embodiments thereof in the configuration as a 2-chamber filling shoe.
b. Removal of the first modular build-up of the 2-chamber filling shoe comprising a first material inlet
c. Providing the second modular build-up for the 3-chamber filling shoe comprising a second material inlet
d. Inserting the feeding vaned wheel in the third chamber of the second modular build-up
e. Mounting of the second modular build-up on the base module of the impeller filling shoe This method is characterised by a particularly simple and quick change of function from an impeller filling shoe according to the invention in the 2-chamber configuration to an impeller filling shoe according to the invention in the 3-chamber configuration. Since the base module remains the same for both configurations, only a constructive exchange of the functionalized modular build-ups is necessary. In a preferred embodiment, the steps are carried out in the above sequence. However, it can also be preferred to carry out the method steps in a different sequence or parallel to each other. For example, the feeding vaned wheel can be inserted into the third chamber of the second modular build-up prior to removing the first modular build-up of the 2-chamber filling shoe. It may also be preferable that the feeding vaned wheel is already presently installed in the third chamber of the second modular build-up.

In further preferred embodiment, the invention relates a method for converting a 3-chamber filling shoe to a 2-chamber filling shoe comprising the following steps:

a. Providing an impeller filling shoe according to the invention or preferred embodiments thereof in the configuration as a 3-chamber filling shoe
b. Removal of the second modular build-up of the 3-chamber filling shoe comprising a second material inlet and the feeding vaned wheel
c. Providing the first modular build-up comprising a first material inlet
d. Mounting of the first modular build-up on the base module of the impeller filling shoe This preferred method is essentially in a direction opposite to the previously described method and is characterized by an easy and reliable change of function from an impeller filling shoe according to the invention in the 3-chamber configuration to an impeller filling shoe according to the invention in the 2-chamber configuration. Also in this case it can be preferred that the steps are carried out in the order given or in any other order.

The conversion of the impeller filling shoe can preferably be carried out outside the tablet press or while it is mounted in the tablet press.

In a preferred embodiment, the invention relates a method for converting a rotary press comprising a 2-chamber filling shoe to a rotary press comprising a 3-chamber filling shoe comprising the following steps a. Providing a rotary press comprising an impeller filling shoe according to the invention, the impeller filling shoe being present mounted in the configuration as a 2-chamber filling shoe
b. Removal of the first modular build-up of the 2-chamber filling shoe comprising a first material inlet
c. Providing the second modular build-up for the 3-chamber filling shoe comprising a second material inlet
d. Inserting the feeding vaned wheel in the third chamber of the second modular build-up
e. Mounting of the second modular build-up on the base module of the impeller filling shoe
f. Changing the outlet tube of the material feeding device from the first position to the second position
g. Connecting the feeding vaned wheel to the gearbox using a pluggable drive shaft.

In the preferred embodiment, the impeller filling shoe is converted from a 2-chamber filling shoe configuration to a 3-chamber filling shoe configuration, while the filling shoe remains at least partially mounted inside the tablet press. Thus, for the impeller filling shoe the base module does not have to be replaced. It can remain mounted inside the tablet press. When mounted, the 2-chamber filling shoe is preferably connected to a gearbox outside the impeller filling shoe by means of two drive shafts. It is advantageous that this connection does not have to be disconnected for functional conversion. Instead, only the first modular build-up is replaced by the second modular build-up comprising the feeding vaned wheel. After connecting the feeding vaned wheel to the gearbox and changing the outlet tube of the material feeding device to the material inlet, the impeller filling shoe is already ready for operation as a 3-chamber filling shoe. The first position of the outlet tube preferably refers to the position above the first material inlet, while the impeller filling shoe is mounted as a 2-chamber filling shoe. The second position preferably corresponds to the alignment of the outlet tube with the second material inlet of the 3-chamber filling shoe.

In a preferred embodiment, the invention relates a method for converting a rotary press comprising a 3-chamber filling shoe into a rotary press comprising a 2-chamber filling shoe comprising the following steps:

a. Providing a rotary press comprising an impeller filling shoe according to the invention, the impeller filling shoe being present mounted in the configuration as a 3-chamber filling shoe
b. Disconnecting the drive shaft mounted between the feeding vaned wheel and the gearbox
c. Removal of the second modular build-up of the 3-chamber filling shoe comprising the second material inlet and the feeding vaned wheel
d. Providing the first modular build-up comprising a first material inlet
e. Mounting of the first modular build-up on the base module of the impeller filling shoe
f. Changing the outlet tube of the material feeding device from the second position to the first position This preferred method is essentially in the direction opposite to the previously described method and is characterized by an easy and reliable change in function from a rotary press with an impeller filling shoe in the 2-chamber configuration to a rotary press with an impeller filling shoe in the 3-chamber configuration.

These simple method steps for the conversion of an impeller filling shoe represent an outstanding advantage over known methods and state-of-the-art filling devices. These methods can drastically reduce changeover times. In addition, the mounting steps are not associated with the lifting or carrying of heavy components and are therefore particularly health friendly. Furthermore, incorrect mounts are minimized, as the base module remains preferentially mounted in the tablet press during the entire rebuild. In this case it is not necessary to connect or disconnect the drive shafts for the filling vaned wheel or the proportionating vaned wheel.

In the following, the invention will be described in greater detail using examples but without being limited to these.

DETAILED DESCRIPTION OF THE FIGURES

Figure 1:
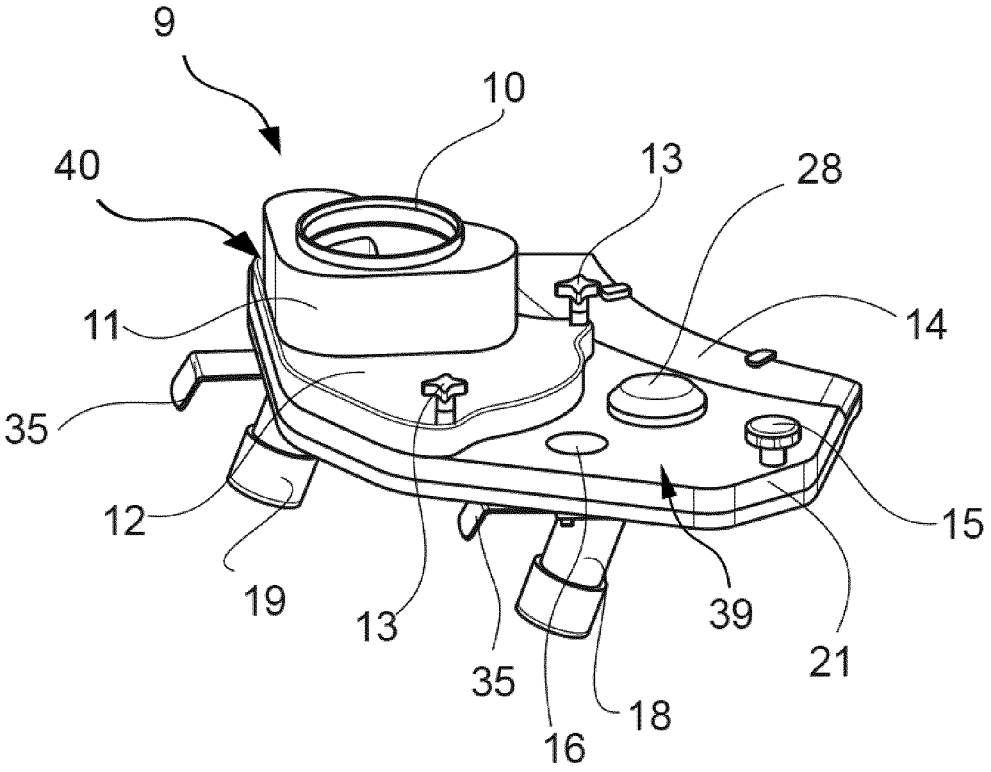
FIGS. 1-3 Schematic diagrams of a preferred embodiment of the impeller filling shoe as a 2-chamber filling shoe FIGS. 4, 5 Schematic diagrams of a preferred embodiment of the first modular build-up for a 2-chamber filling shoe FIGS. 6-8 Schematic diagrams of a preferred embodiment of the impeller filling shoe as a 3-chamber filling shoe FIGS. 9-11 Schematic diagrams of a preferred embodiment of the impeller filling shoe as a 3-chamber filling shoe FIG. 12 Schematic diagram illustrating the connection of a preferred embodiment of the 2-chamber filling shoe to the gearbox with drive motor FIG. 13 Schematic diagram of a preferred embodiment of the 2-chamber filling shoe from below to illustrate the plug-in adaptors for the drive shafts FIG. 14 Schematic diagram illustrating the connection of a preferred embodiment of the 3-chamber filling shoe to the gearbox with drive motor FIG. 15 Schematic diagram of a preferred embodiment of the 3-chamber filling shoe from below to illustrate the attaching of the drive shafts FIGS. 16*a-c* Schematic views of a preferred embodiment of the material feeding device for flexible adjustment for a 2-chamber or 3-chamber filling shoe
Figure 2:
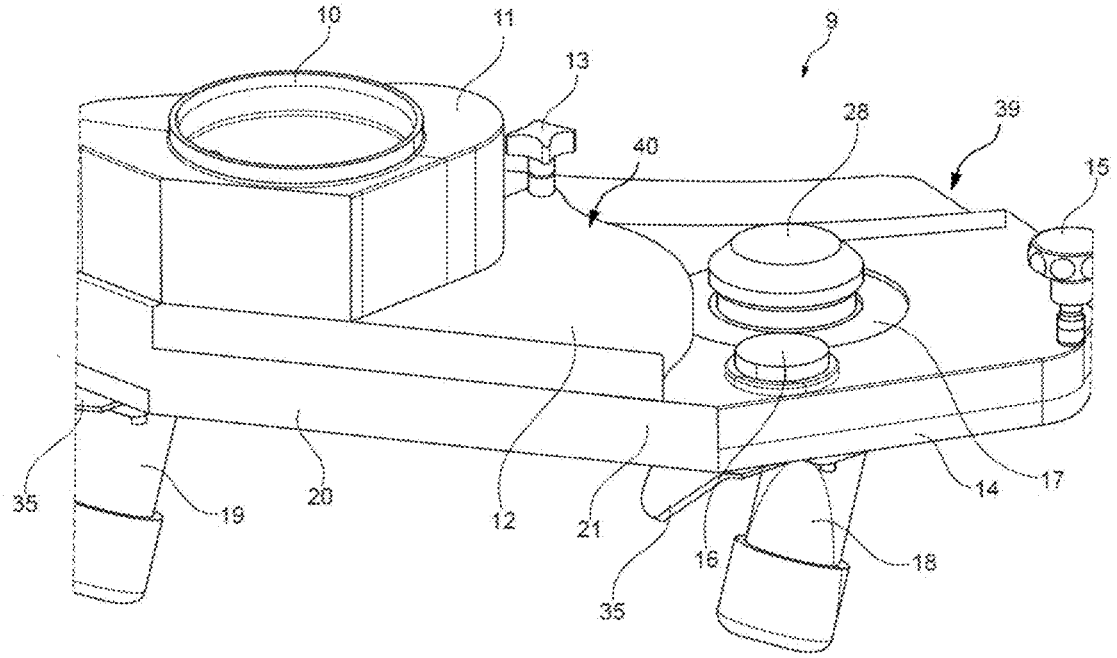
Figure 3:
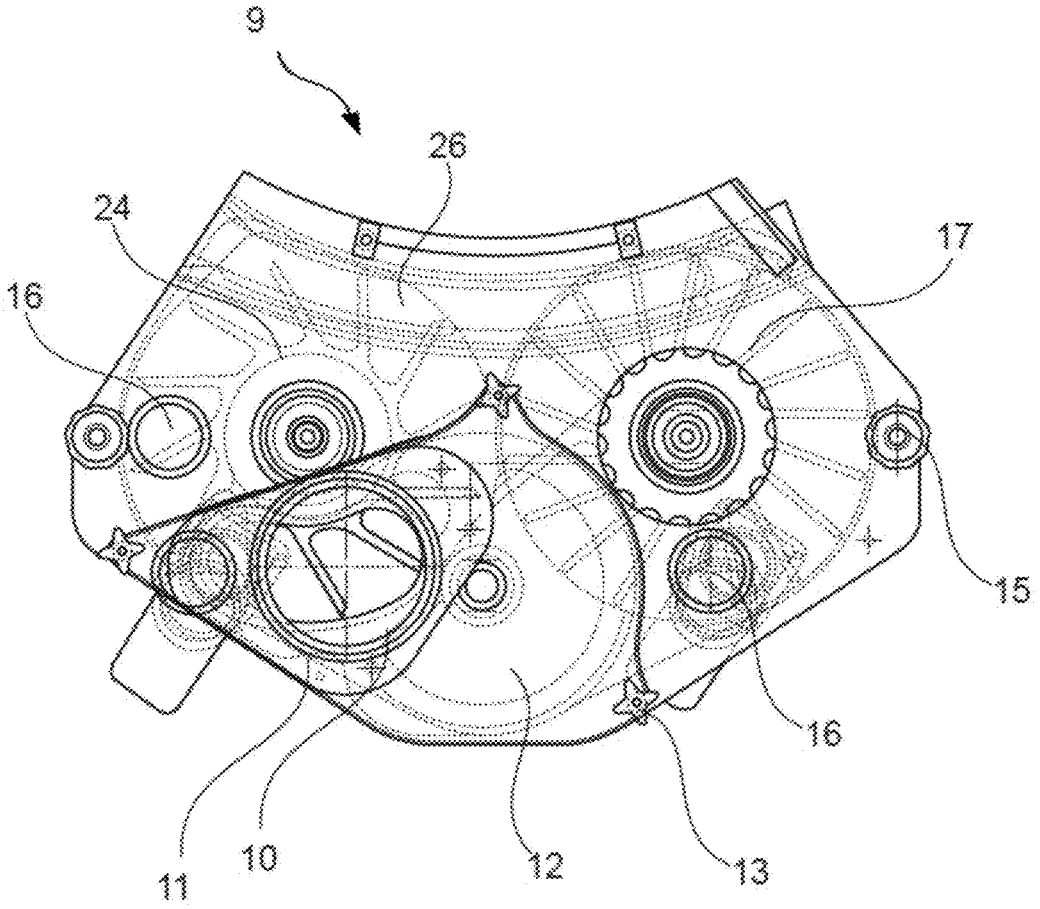

FIGS. 1-3 show different schematic views of a preferred embodiment of the impeller filling shoe as a 2-chamber filling shoe 9. FIG. 1 shows a three-dimensional overview of the 2-chamber filling shoe 9, wherein only the components visible from the outside are shown. FIG. 2 shows a schematic 3D cross-sectional view and FIG. 3 a plan view of the preferred embodiment of the 2-chamber filling shoe 9.

The 2-chamber filling shoe 9 shown in FIGS. 1-3 comprises a base module 39, which has a base plate 14 and a cover 21. The base plate 14 and the cover 21 form a left chamber for the filling vaned wheel 24 and a right chamber for the proportioning vaned wheel 17 in the base module 39. The cover 21 of the base module 39 can be fastened to the base plate 14 using T-handle screws 15. The mounting element 28 is used to support and seal the drive shafts of the vaned wheels. The 2-chamber filling shoe 9 has a first modular build-up 40 installed on the cover 21 of the base module. The fixing of the modular build-up 40 is also preferably carried out by means of T-handle screws 13, which allow simple assembly. The modular build-up 40 contains in particular a first material inlet 11, which is equipped with a clamping ring 10 for the material inlet sleeve. The outlet tube of the material feeding device (not shown) is connected to the material inlet 11. During operation of the 2-chamber filling shoe 9 in a tablet press, powdery material is first fed from the material feeding device through the material inlet 11 into the left chamber, comprising the filling vaned wheel 24. The filling vaned wheel 24 usually rotates clockwise in plan view, the proportioning vaned wheel 17 counterclockwise. Thus, the filling vaned wheel 24 rotates in the same direction as the pitch circle of the dies (not shown) at the point of intersection. The pressing material is transferred by the filling vaned wheel 24 from the left side into the filling opening 26 of the base plate 14 and from there into the individual die bores. The filling curve is located in the tablet press, which fills the die bore by withdrawing the lower punch under the die surface. The lower punches can then be lifted after the filling process using a proportioning unit so that a defined filling volume remains in the die holes. The proportioning vaned wheel 17 in the right chamber, which rotates counterclockwise, returns the excess material to the left chamber, i.e. to the filling vaned wheel 24. Powder material can be discharged from the chambers via the material discharge tubes 18 and 19, which are controlled by locking sliders 35. Furthermore, inspection windows 16 enable monitoring of the chambers and vaned wheels during operation.

Figure 4:
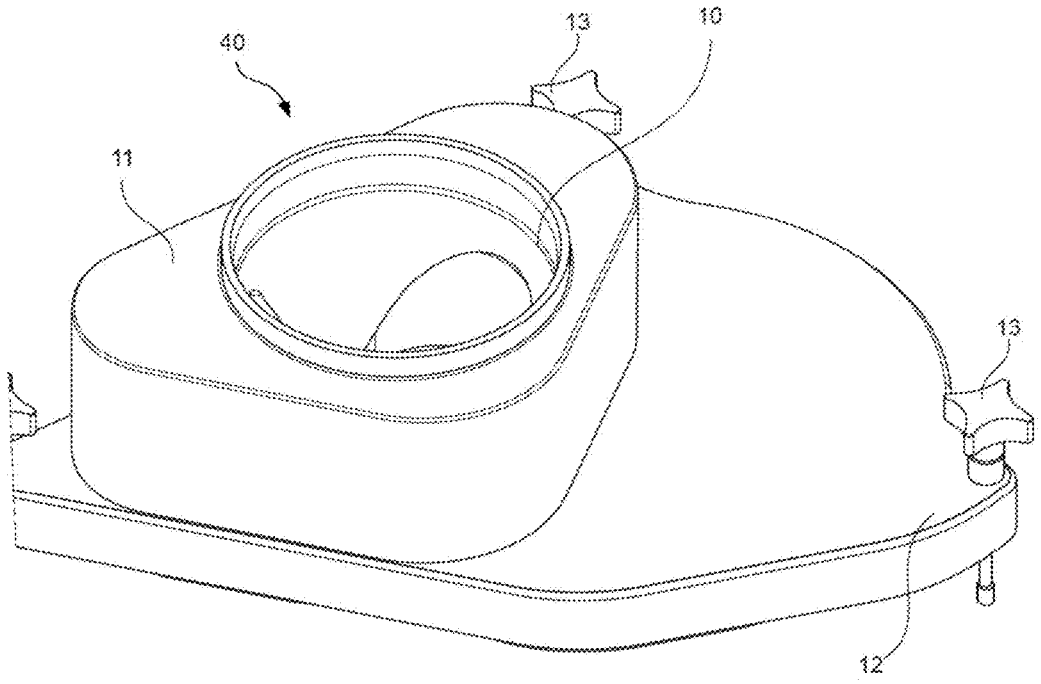
Figure 5:
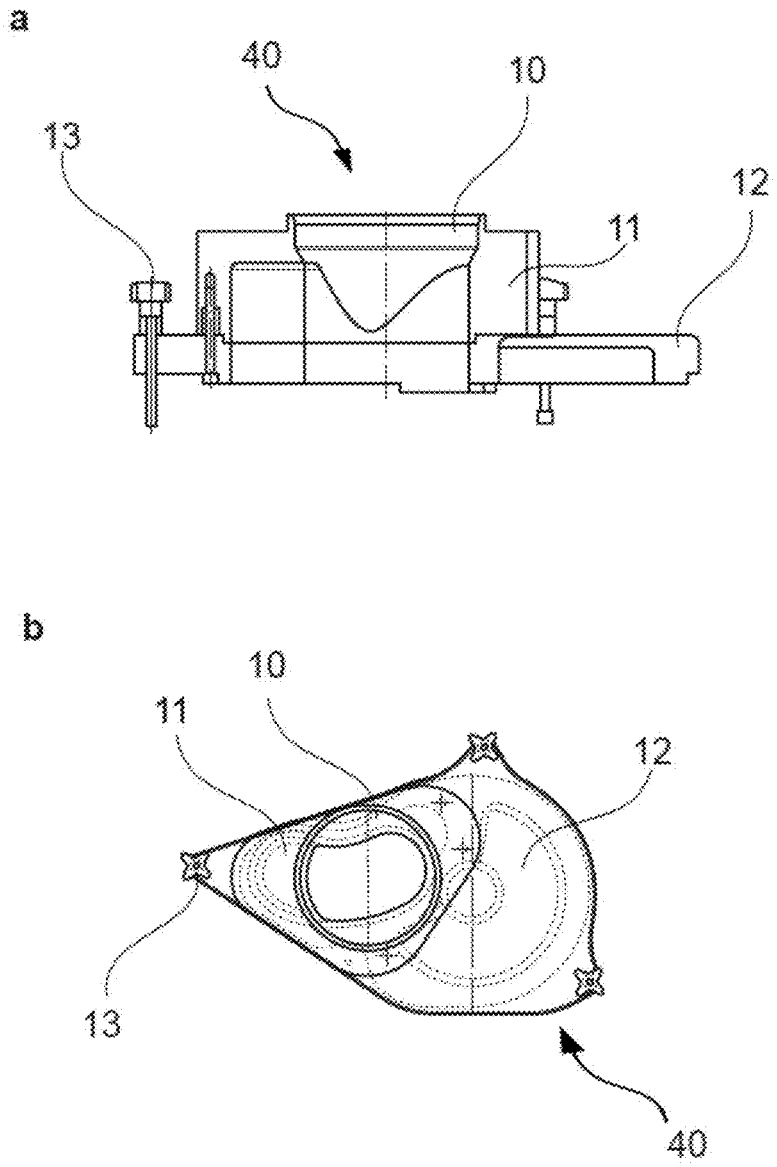

FIGS. 4 and 5 show schematic diagrams of a preferred embodiment of the first modular build-up for a 2-chamber filling shoe 9 according to the FIGS. 1-3. FIG. 4 is a three-dimensional view, FIG. 5A a sectional view and FIG. 5B a plan view. The modular build-up 40 comprises an intermediate plate 12, which can be installed on the base module 39 using T-handle screws 13 as shown in FIGS. 1-3. The material inlet 11 with the clamping ring for the material inlet sleeve is installed on the left side of the intermediate plate 12 so that the material inlet 11 is located in the 2-chamber filling shoe 9 (see FIGS. 1-3) above the filling vaned wheel 24.

Figure 6:
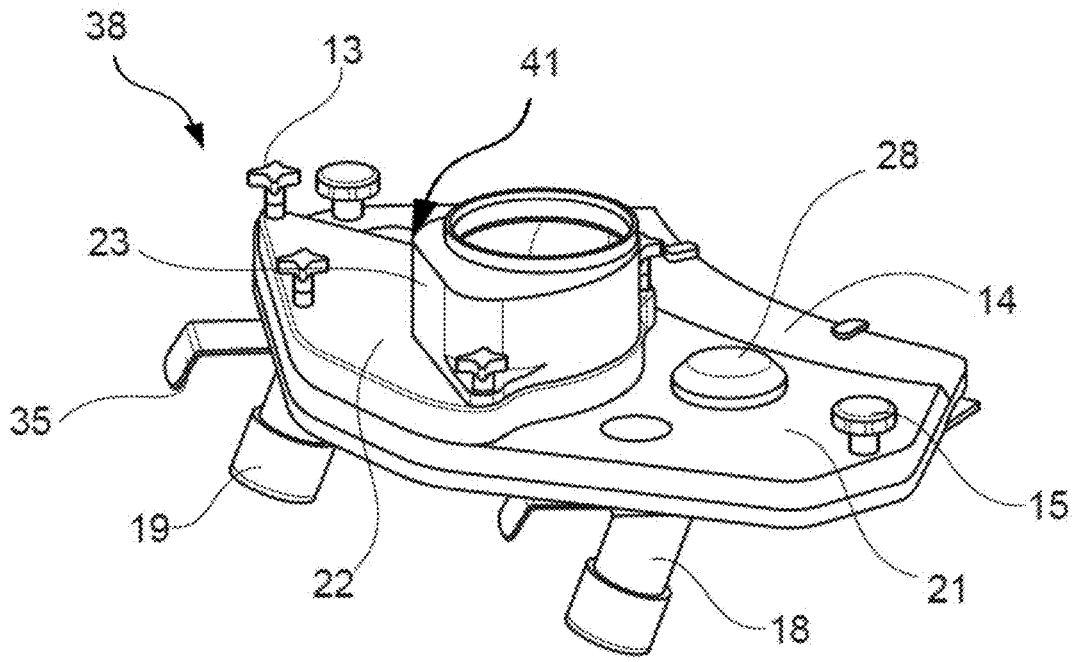
Figure 7:
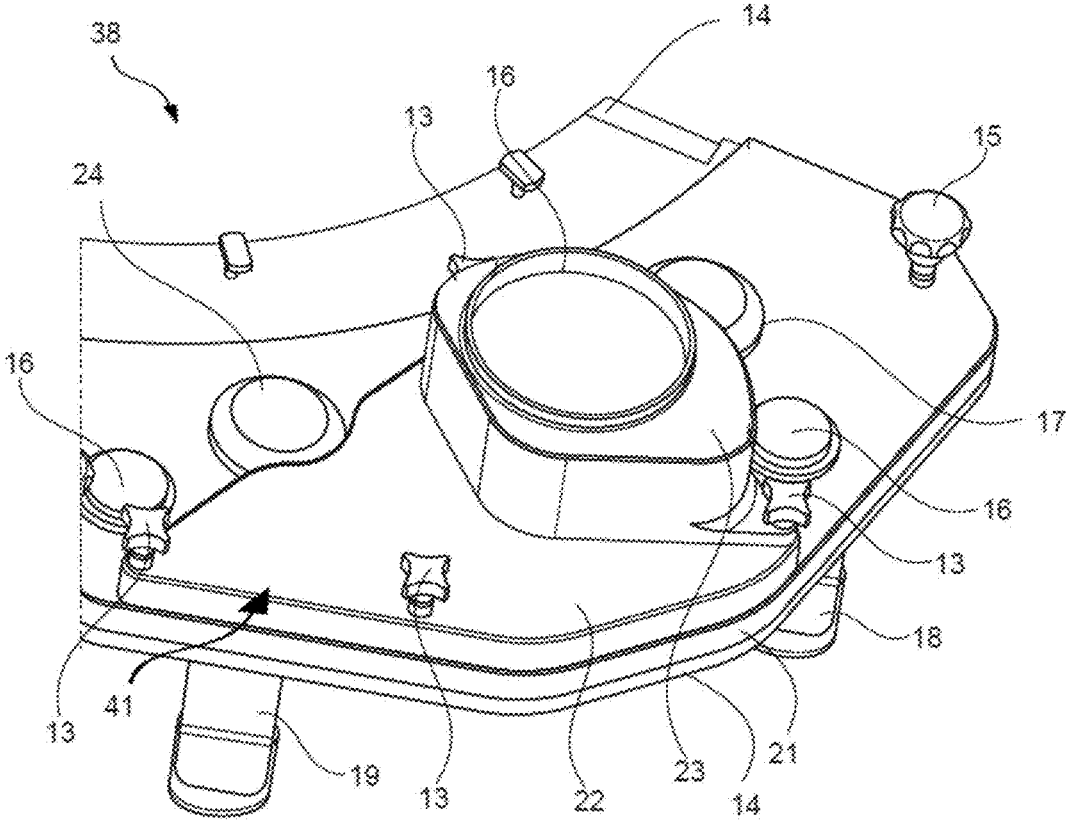
Figure 8:
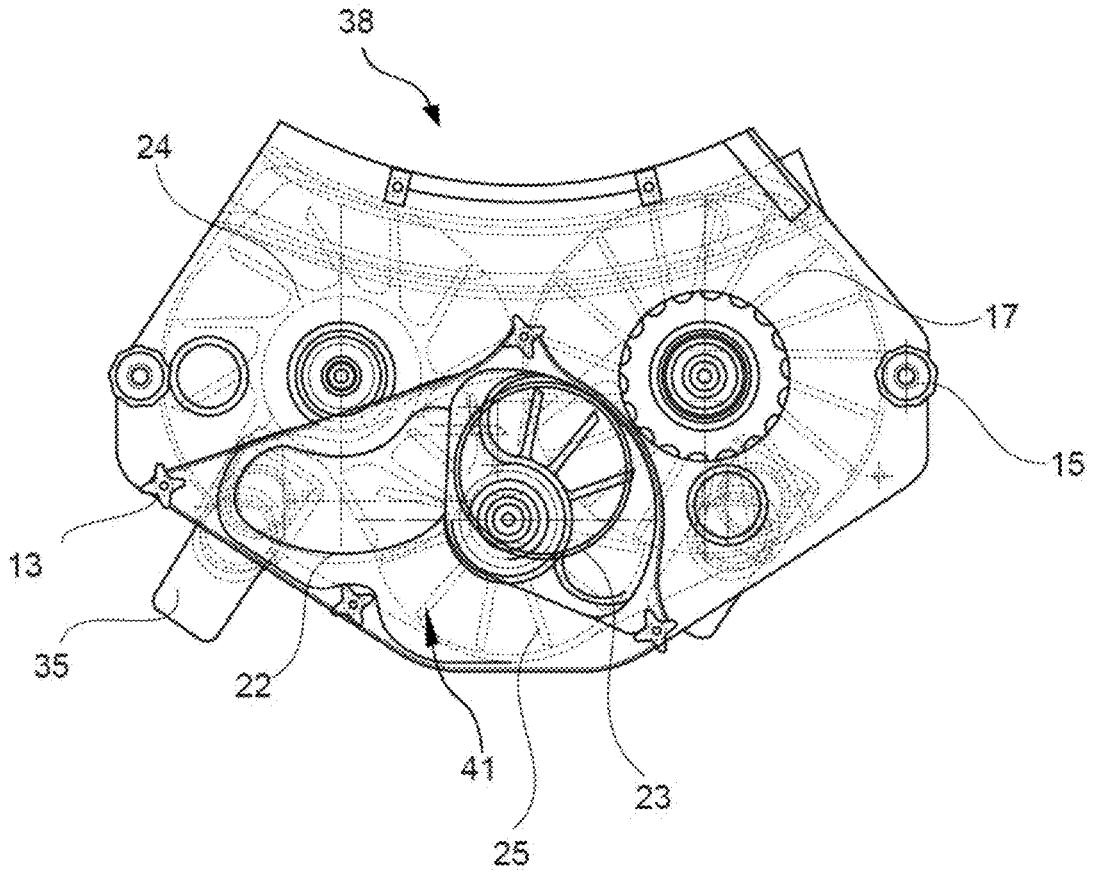

FIGS. 6-8 show different schematic views of a preferred embodiment of the impeller filling shoe as a 3-chamber filling shoe 38. FIG. 6 shows a three-dimensional overview of the 3-chamber filling shoe 38, wherein only the outside visible components are shown. FIG. 7 shows a schematic 3D cross-sectional view and FIG. 8 a plan view of the preferred embodiment of the 3-chamber filling shoe 9.

The 3-chamber filling shoe 38 shown in FIGS. 6-8 comprises the same base module 39 as the 2-chamber filling shoe 9 shown in FIGS. 1-3. The base module 39 comprises a base plate 14 and a matching cover 21, which is fixed to the base plate 14 with T-handle screws 15. In the base module 39, the filling vaned wheel 24 is located in a left chamber and the proportioning vaned wheel 17 in a right chamber. In contrast to the 2-chamber filling shoe 9 shown in FIGS. 1-3, the 3-chamber filling shoe 38 does not have the first modular build-up 40 installed on the base module 39, but the second modular build-up 41. The second modular build-up 41 for the 3-chamber filling shoe 38 comprises an intermediate plate 22, which is installed on the cover 21 of the base module using T-handle screws 13. On the intermediate plate 22 there is the material inlet 23, which is positioned above the middle, third chamber formed by the intermediate plate 22. In the middle, third chamber there is the feeding vaned wheel 25.

In the preferred configuration of the 3-chamber filling shoe 38 shown, the impeller filling shoe thus has three vaned wheels. The outlet tube of the material feeding device (not shown) is connected to the material inlet 23. In the 3-chamber filling shoe 38, the powdery material is not fed directly to the filling vaned wheel 24 as in the case of the 2-chamber filling shoe 9. Instead, the material is fed through the material inlet 23 first to the feeding vaned wheel 25, which is located in the middle, third chamber. When installed, the feeding vaned wheel 25 is located on an outer circle offset from the filling vaned wheel 24. This results in a first Z-stage for the transport path of the powdery material, which is first conveyed by the feeding vaned wheel 25 in the middle chamber to the filling vaned wheel 24 in the left chamber offset below. From the filling impeller 24 the powdery material is transported in a further Z-stage to the material outlet or to the filling opening 26, whereby the die bores are filled as described for the 2-chamber filling shoe 9.

After filling, the filling level of the die holes is proportioned. The lower punches are lifted with the aid of a dosing unit and excess material is fed back to the filling vaned wheel 24 by the proportioning vaned wheel 17. The function of the 3-chamber filling shoe 38 is the same as that of the 2-chamber filling shoe 9 with regard to the filling vaned wheel 24 and the proportioning vaned wheel 17. However, the additional feeding vaned wheel 25 allows an improved material feed. In particular, the additional feeding vaned wheel 25 allows for a double Z-stage and thus a particularly even transport of the powder material. With the 3-chamber filling shoe 38, excellent tableting results can be achieved largely independently of the flow behaviour of the press material.

Figure 9:
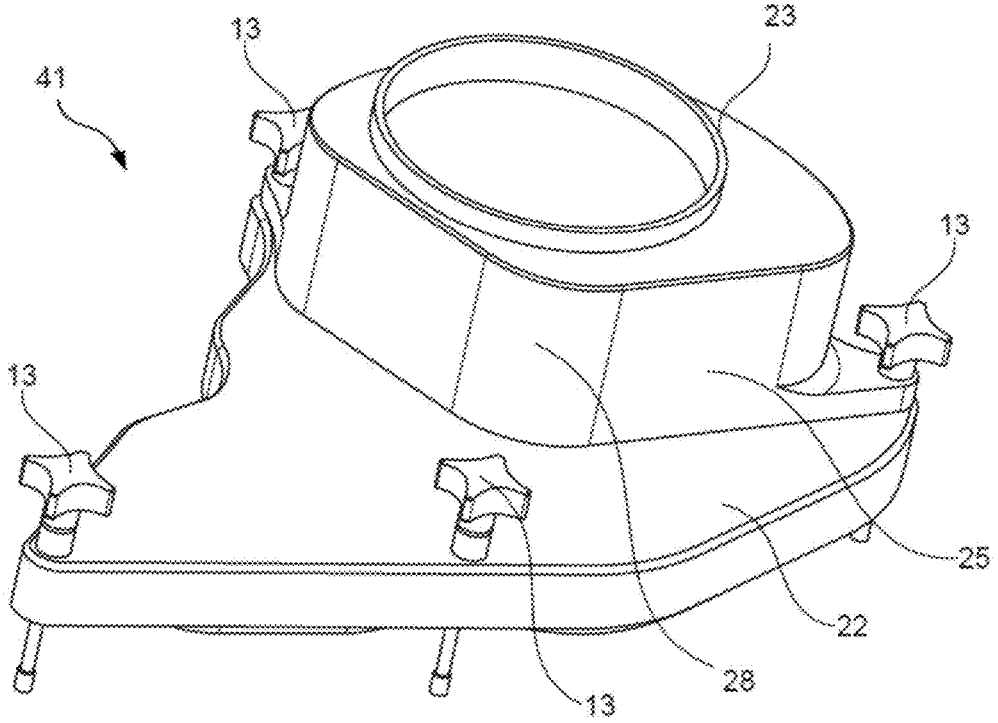
Figure 10:
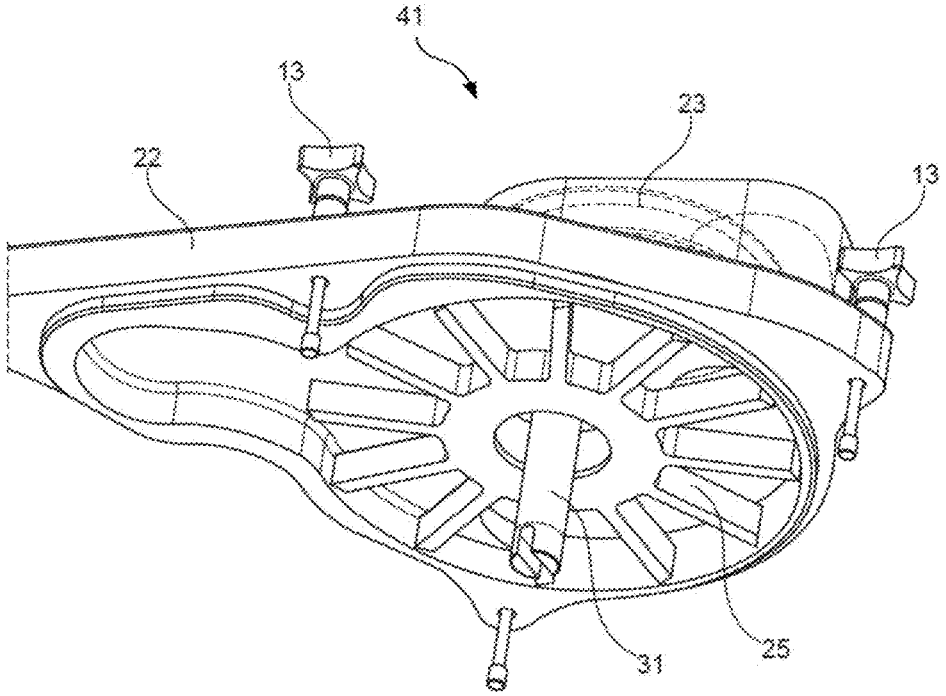
Figure 11:
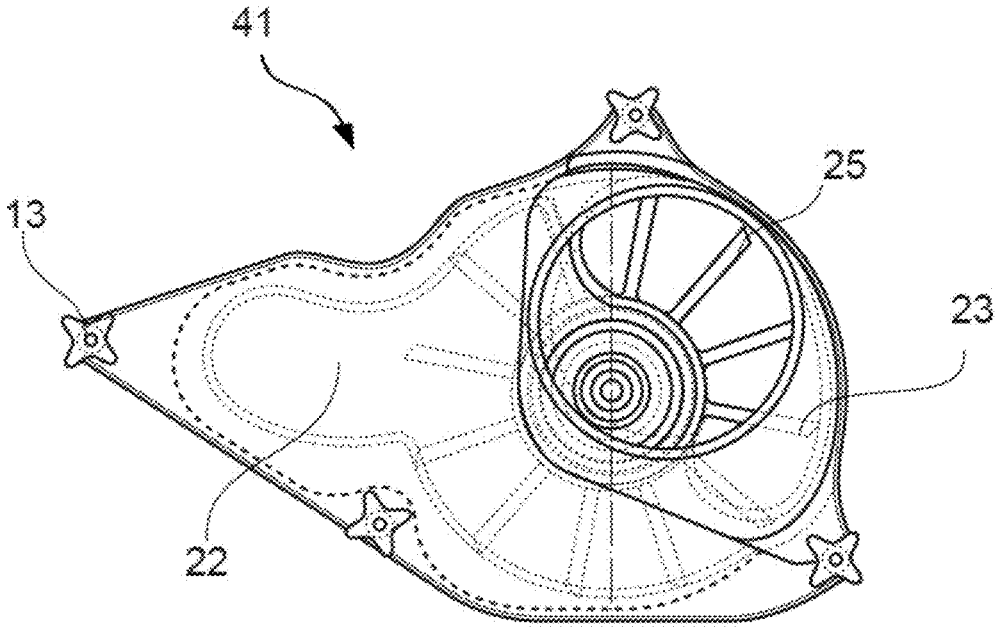

FIGS. 9-11 show schematic diagrams of a preferred embodiment of the second modular build-up 41 for the 3-chamber filling shoe 38 according to the FIGS. 6-8. FIG. 9 shows a three-dimensional view of modular build-up 41 from an oblique top perspective, whereas FIG. 10 shows an oblique bottom view. FIG. 11 corresponds to a plan view of the preferred design of the modular build-up 41.

The second modular build-up 41 comprises an intermediate plate 22, which can be installed on the base module 39 using T-handle screws 13 as shown in FIGS. 6-8. As shown in particular in FIG. 10, there is a middle, third chamber in the intermediate plate 22 in which the feeding vaned wheel 25 is located. The feeding vaned wheel 25 can be put into operation by means of a pluggable drive shaft 31. The fastening element 28 allows the bearing and sealing of the drive shaft 31 of the vaned wheel 25. The material inlet 23 is positioned on the intermediate plate 22 in such a way that the powdery material is first fed into the middle chamber of the feeding vaned wheel 25. As explained for FIGS. 6-8, a double Z-stage for the transport of the powdery material can be achieved, which ensures an even filling.

Figure 12:
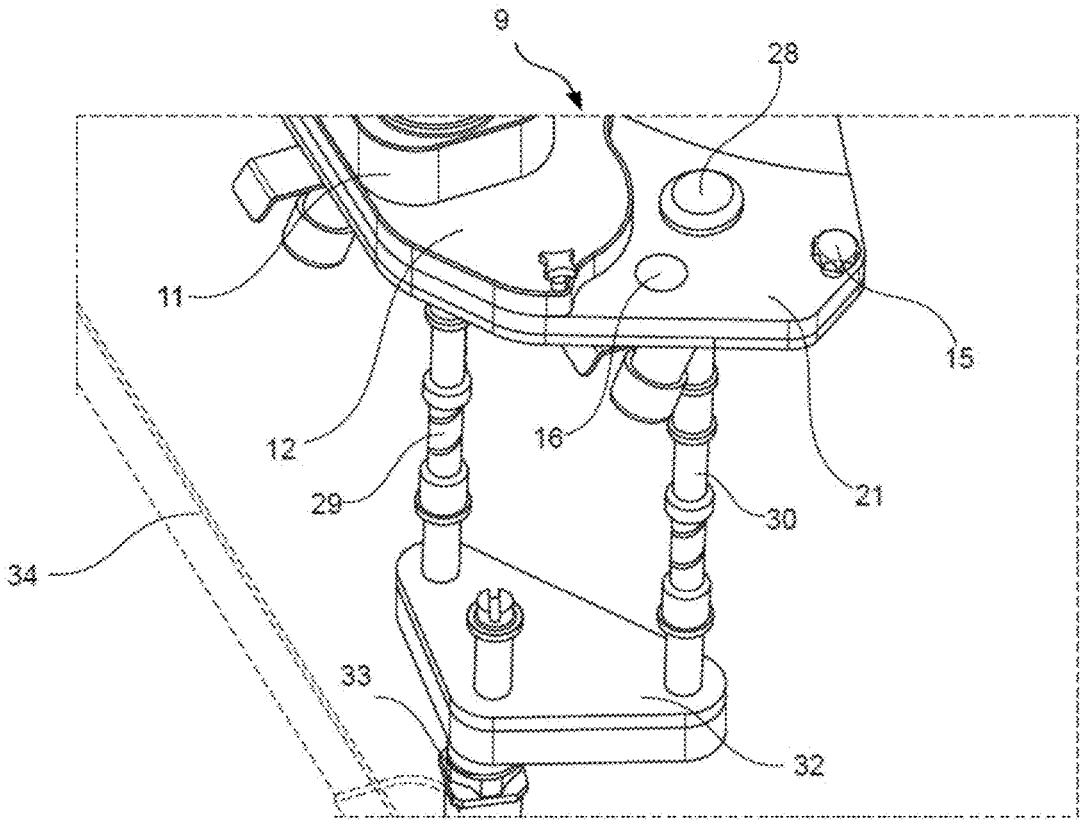

FIG. 12 shows a schematic diagram of the connection of the 2-chamber filling shoe 9 to the gearbox 32 for driving the vaned wheels. The gearbox 32 is located below the vibrationally decoupled carrier plate 34 of the tablet press and is driven by a servo motor 33. The gearbox 32 is connected to the vaned wheels by means of two pluggable drive shafts 29 and 30. A first drive shaft 29 drives the left filling vaned wheel 24, while a second drive shaft 30 drives the right proportioning vaned wheel 17. Since there is no feeding vaned wheel in the configuration of the 2-chamber filling shoe 9, a third drive shaft is not required.

Figure 13:
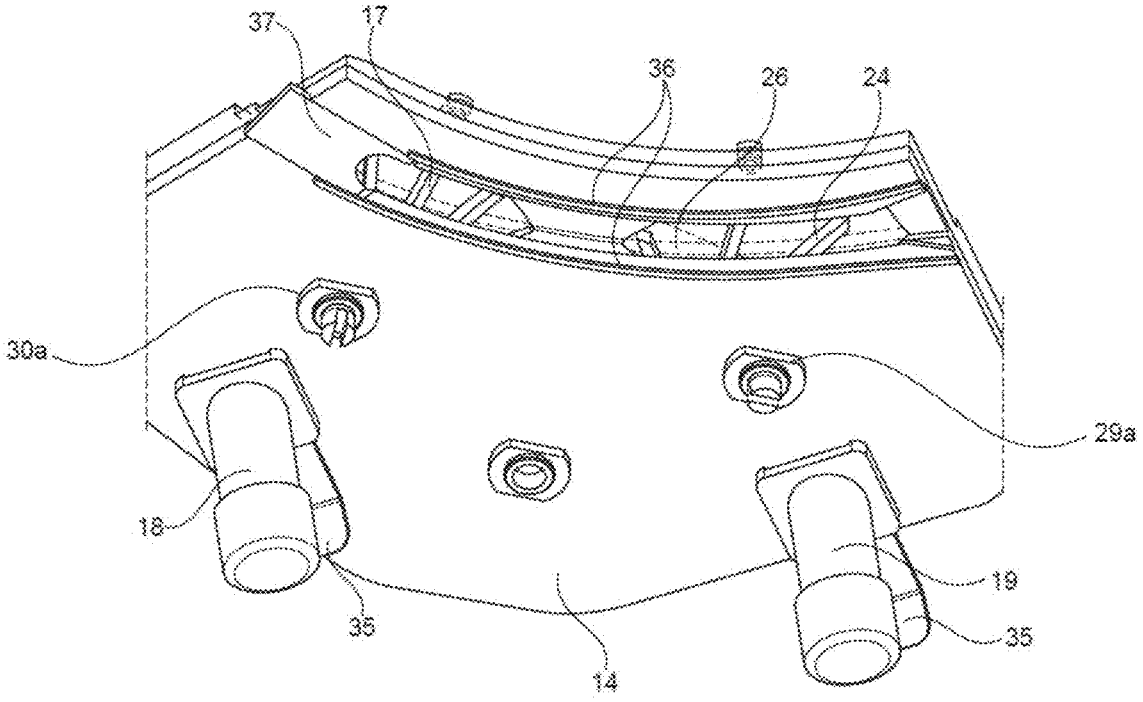

FIG. 13 shows a schematic view of a preferred embodiment of the 2-chamber filling shoe 38 from below. As can be seen there, an adaptor 30*a* for the drive shaft 30 for driving the right proportioning vaned wheel 17 and an adaptor 29*a* for the drive shaft 29 for the left proportioning vaned wheel 24 are available on the base plate 14. Furthermore, FIG. 13 illustrates the sandwich seal 36 and the resilient pressure piece 37, which prevent powder material from escaping from the surface of the die plate out of the area of the filling shoe.

Figure 14:
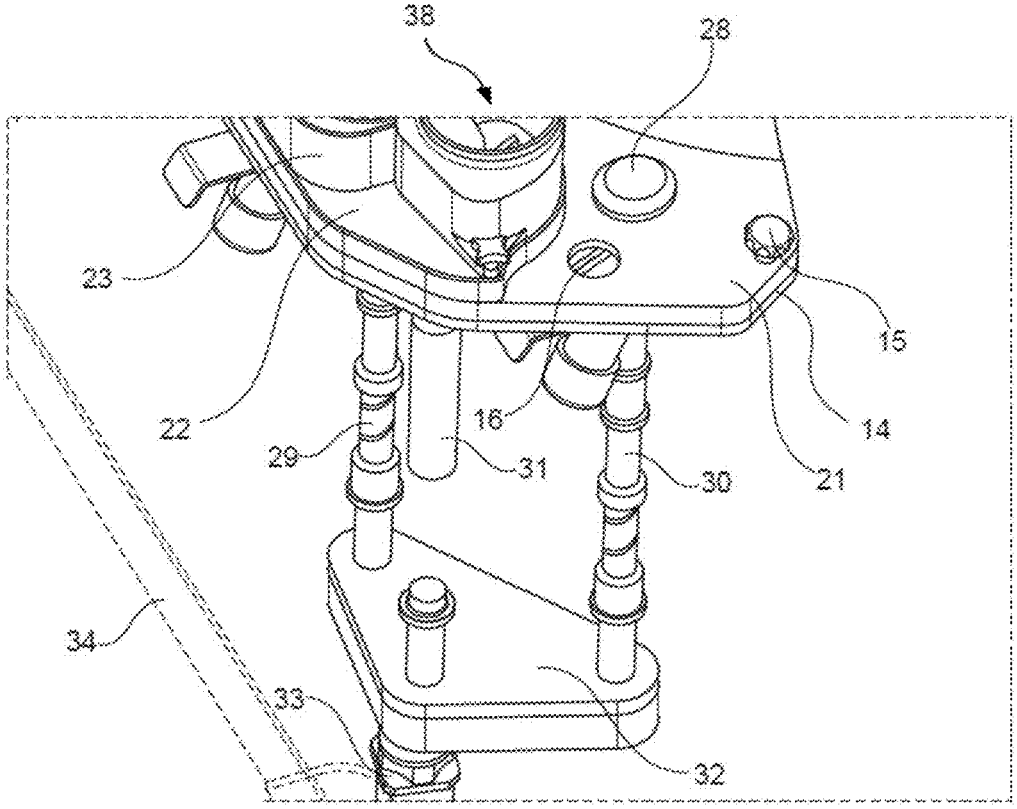

FIG. 14 shows a schematic diagram of the connection of the 3-chamber filling shoe 38 to the gearbox 32 for driving the vaned wheels. The gearbox 32 is located below the vibrationally decoupled carrier plate 34 of the tablet press and is driven by a servo motor 33. The gearbox 32 is connected to the vaned wheels by means of three pluggable drive shafts 29, 30 and 31. A first drive shaft 29 drives the left filling vaned wheel 24, while a second drive shaft 30 drives the right proportioning vaned wheel 17, and a third drive shaft 31 drives the middle feeding vaned wheel 31.

Figure 15:
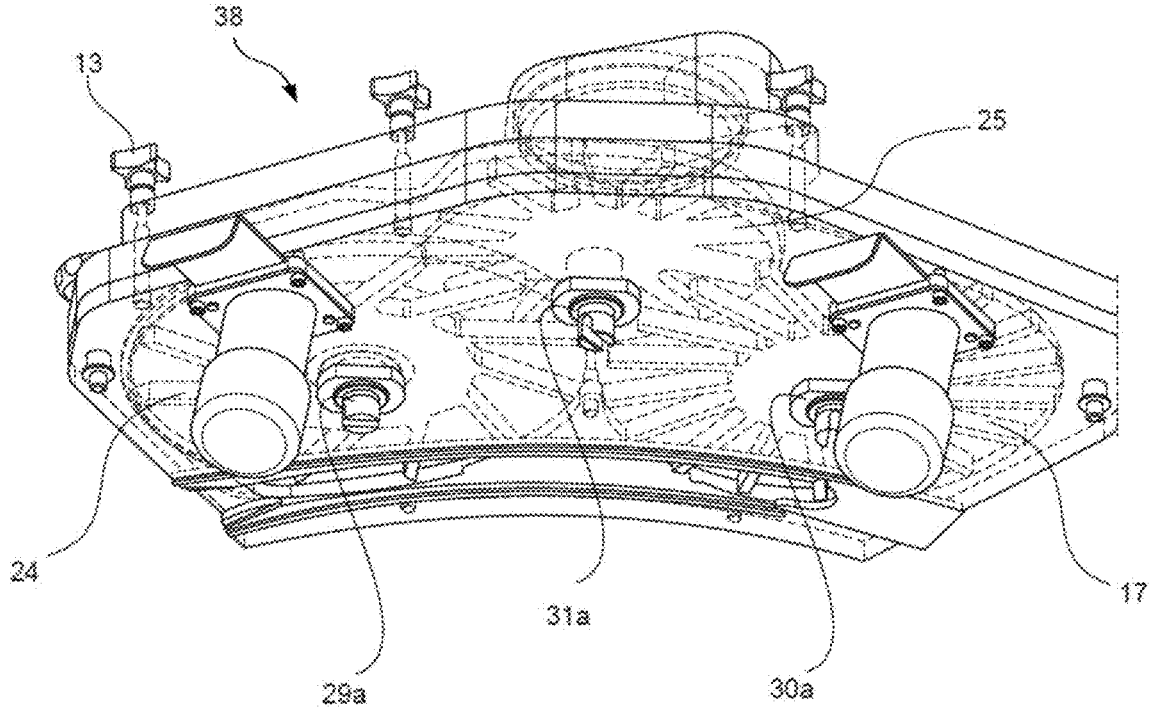

FIG. 15 shows a schematic view of a preferred embodiment of the 3-chamber filling shoe 38 from below. As can be seen there, an adaptor 30*a* for the drive shaft 30 for driving the right proportioning vaned wheel 17, an adaptor 29*a* for the drive shaft 29 for the left proportioning vaned wheel 24 and a third adaptor 31*a* for driving the drive shaft 31 for driving the middle feeding vaned wheel 25 are available on the base plate 14.

Figure 16:
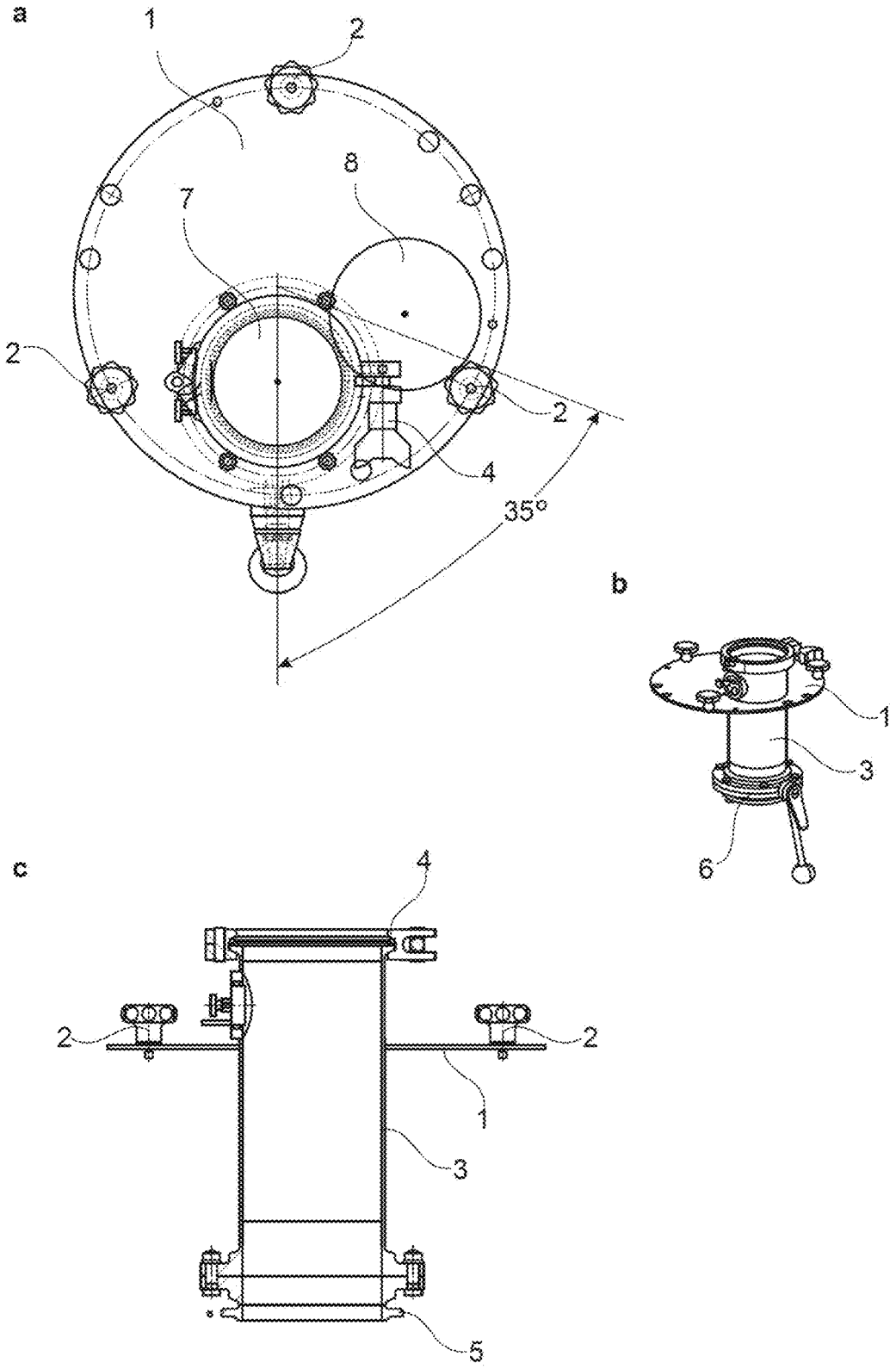

FIGS. 16*a-c* show schematic views of a preferred embodiment of the material feeding device 43 for flexible adjustment for a 2-chamber or 3-chamber filling shoe. FIG. 16*a* shows the material feeding device 43 in a plan view, FIG. 16*b* in a three-dimensional side view and FIG. 3*c* in the sectional view. The material feeding device 43 is located in a head piece above the filling shoe and comprises an outlet tube 3, which is adjustable in two positions 7 and 8. Three T-handle screws 2 and a mounting flange or plate 1 are used to install the material feeding device 43 in the tablet press. The Tri-Clamp flanges 4 and 5 ensure a secure sealing of the outlet tube 3. Furthermore, there is a shut-off valve 6 at the lower end of the outlet tube 3. The material is fed into the material inlet for the 2-chamber or 3-chamber filling shoe via the outlet tube 3. As shown in FIGS. 1-15, if the impeller filling shoe is configured as a 2-chamber filling shoe 9, the material inlet 11 is in a different position from the material inlet 23 for the 3-chamber filling shoe 38. It is therefore necessary to adjust the position of the outlet tube 3 to the position of the respective material inlet. For this purpose, the outlet pipe 3 is positioned asymmetrically in the circular mounting flange 1 in such a way that the outlet tube 3 can be swivelled between two positions 7 and 8. In the preferred embodiment shown, the swivel angle is 35°. However, the swivel angle depends on the positioning of the material inlets 11 and 23 in the different modular build-ups 40 and 41. In the present case, position 7 corresponds to the position of the outlet tube 3 for the 2-chamber filling shoe 9, while position 8 corresponds to the position of the outlet tube 3 for the 3-chamber filling shoe 38. The shown embodiment of the material feeding device 43 allows a particularly easy change of assembly between the two configurations of the impeller filling shoe.

It should be noted that various alternatives to the described embodiments of the invention might be used to carry out the invention and to arrive at the solution according to the invention. The impeller filling shoe according to the invention, the rotary press comprising the impeller filling shoe according to the invention as well as the described methods are therefore not limited in their designs to the above preferred embodiments. Rather, a variety of design variants is conceivable that may differ from the illustrated solution. The aim of the claims is to define the scope of protection for the invention. The scope of protection of the claims is aimed at covering the impeller filling shoe according to the invention, a rotary press comprising the impeller filling shoe according to the invention and preferred methods as well as equivalent embodiments thereof.

LIST OF REFERENCE NUMERALS

1 Attachment flange/plate
2 Tommy screw
3 Outlet tube
4 Tri-clamp flange
5 Tri-clamp flange
6 Shut-off valve
7 Position of the material opening for the 2-chamber filling shoe
8 Position of the material opening for the 3-chamber filling shoe
9 2-chamber filling shoe
10 Clamping ring for the material inlet sleeve
11 First material inlet for the 2-chamber filling shoe
12 First intermediate plate for the 2-chamber filling shoe
13 T-handle screw
14 Base plate of the base module
15 T-handle screw
16 Inspection window
17 Proportioning vaned wheel
18 Material discharge tube right chamber
19 Material discharge tube left chamber
21 Cover of the base module
22 Second intermediate plate for the 3-chamber filling shoe
23 Second material inlet for the 3-chamber filling shoe
24 Filling vaned wheel
25 Feeding vaned wheel
26 Material outlet and/or filling opening in the base plate
28 Bearing and sealing of the drive shaft of the vaned wheels
29 Pluggable drive shaft for the left filling vaned wheel
29*a* Adaptor for the drive shaft for the left filling vaned wheel
30 Pluggable drive shaft for the right proportioning vaned wheel
30*a* Adaptor for the drive shaft for the right proportioning vaned wheel
31 Pluggable drive shaft for the third/middle feeding vaned wheel

31*a* Adaptor for the drive shaft for the third/middle feeding vaned wheel
32 Gearbox for driving the vaned wheels
33 Servo motor
34 Vibration-decoupled carrier plate
35 Locking slider for the material discharge tubes 18 and 19
36 Sandwich seal
37 Resilient pressure piece
38 3-chamber filling shoe
39 Base module
40 First modular build-up for the 2-chamber filling shoe
41 Second modular build-up for the 3-chamber filling shoe
43 Material feeding device

The invention claimed is:

1. An impeller filling shoe for material feed to die bores of a rotary press, the impeller filling shoe comprising:

a modular impeller filling shoe configured to enable a change in function between a 2-chamber filling shoe and a 3-chamber filling shoe, the 2-chamber filling shoe comprising a filling vaned wheel and a proportioning vaned wheel, the 3-chamber filling shoe comprising a filling vaned wheel, a proportioning vaned wheel and a feeding vaned wheel, and wherein the modular impeller filling shoe excludes a gearbox for driving the vaned wheels, wherein the modular impeller filling shoe comprises a base module in which the filling vaned wheel is present in a first left chamber and the proportioning vaned wheel is present in a second right chamber, wherein the modular impeller filling shoe comprises a base module in which the filling vaned wheel is present in a first left chamber and the proportioning vaned wheel is present in a second right chamber, wherein the 2-chamber filling shoe has a first modular build-up being mountable to the base module and having a first material inlet which in a mounted state is located above the filling vaned wheel and the 3-chamber filling shoe has a second modular build-up in which the feeding vaned wheel is present inserted into a third center chamber, the second modular build-up being mountable on the base module and having a second material inlet.

2. The modular impeller filling shoe of claim 1, wherein the vaned wheels each have an adaptor for attaching a driving shaft for connecting an external gearbox.

3. The modular impeller filling shoe of claim 1, wherein individual mounting components of the modular impeller filling shoe weigh no more than 20 kg.

4. The modular impeller filling shoe of claim 1, wherein in the 2-chamber filling shoe, pressing material is passed from the first material inlet to the filling opening and the die bores in one Z-stage and in the 3-chamber filling shoe, pressing material is passed from the second material inlet to the filling opening and the die bores in two Z-stages.

5. The modular impeller filling show of claim 1, wherein the base module has a filling opening at the bottom which is provided with resilient, exchangeable sandwich seals on both sides.

6. The modular impeller filling shoe of claim 1, wherein the components of the modular impeller filling shoe comprise at least one of the materials selected from the group comprising stainless steel, aluminium and plastic.

7. The modular impeller filling shoe of claim 1, in combination with a rotary press, wherein the rotary press has a gearbox for driving the vaned wheels which is located external to the modular impeller filling shoe and the vaned wheels are connectible to the gearbox by means of pluggable driving shafts.

8. The rotary press according to claim 7, wherein the gearbox for driving the vaned wheels is located below the modular impeller filling shoe.

9. The rotary press according to claim 7 wherein, the rotary press has a material feeding device in a head piece above the filling shoe comprising an outlet tube wherein the outlet tube is settable in at least two positions such that in case of a 2-chamber filling shoe being mounted the outlet tube is in a first position above the first material inlet of the 2-chamber filling shoe and in case of a 3-chamber filling shoe being mounted the outlet tube is in a second position above the second material inlet of the 3-chamber filling shoe.

10. A method for converting a 2-chamber filling shoe to a 3-chamber filling shoe, the method comprising:

a. providing a modular impeller filling shoe comprising a modular impeller filling shoe configured to enable a change in function between a 2-chamber filling shoe and a 3-chamber filling shoe, the 2-chamber filling shoe comprising a filling vaned wheel and a proportioning vaned wheel, the 3-chamber filling shoe comprising a filling vaned wheel, a proportioning vaned wheel and a feeding vaned wheel, the modular impeller filling shoe excluding a gearbox for driving the vaned wheels, the modular filling shoe initially configured as a 2-chamber filling shoe, and the modular impeller filling shoe further comprising a base module in which the filling vaned wheel is present in a first left chamber and the proportioning vaned wheel is present in a second right chamber, wherein the 2-chamber filling shoe has a first modular build-up being mountable to the base module and having a first material inlet which in a mounted state is located above the filling vaned wheel and the 3-chamber filling shoe has a second modular build-up in which the feeding vaned wheel is present inserted into a third center chamber, the second modular build-up being mountable on the base module and having a second material inlet;

b. removing the first modular build-up of the 2-chamber filling shoe comprising a first material inlet;

c. providing the second modular build-up for the 3-chamber filling shoe comprising a second material inlet;

d. inserting the feeding vaned wheel in the third chamber of the second modular build-up; and e. mounting of the second modular build-up on the base module of the modular impeller filling shoe.

11. A method for converting a 3-chamber filling shoe to a 2-chamber filling shoe, the method comprising:

a. providing a modular impeller filling shoe comprising a modular impeller filling shoe configured to enable a change in function between a 2-chamber filling shoe and a 3-chamber filling shoe, the 2-chamber filling shoe comprising a filling vaned wheel and a proportioning vaned wheel, the 3-chamber filling shoe comprising a filling vaned wheel, a proportioning vaned wheel and a feeding vaned wheel, the modular impeller filling shoe excluding a gearbox for driving the vaned wheels, the modular filling shoe initially configured as a 3-chamber filling shoe, and the modular impeller filling shoe further comprising a base module in which the filling vaned wheel is present in a first left chamber and the proportioning vaned wheel is present in a second right chamber, wherein the 2-chamber filling shoe has a first modular build-up being mountable to the base module and having a first material inlet which in a mounted state is located above the filling vaned wheel and the 3-chamber filling shoe has a second modular build-up in which the feeding vaned wheel is present inserted into a third center chamber, the second modular build-up being mountable on the base module and having a second material inlet;

b. removing the second modular build-up of the 3-chamber filling shoe comprising a second material inlet and the feeding vaned wheel;

c. providing the first modular build-up comprising a first material inlet;

d. mounting of the first modular build-up on the base module of the modular impeller filling shoe.

12. A method for converting a 2-chamber filling shoe to a 3-chamber filling shoe, the method comprising:

a. providing a rotary press in combination with a modular impeller filling shoe comprising a modular impeller filling shoe configured to enable a change in function between a 2-chamber filling shoe and a 3-chamber filling shoe, the 2-chamber filling shoe comprising a filling vaned wheel and a proportioning vaned wheel, the 3-chamber filling shoe comprising a filling vaned wheel, a proportioning vaned wheel and a feeding vaned wheel, the modular impeller filling shoe excluding a gearbox for driving the vaned wheels, the modular filling shoe initially configured as a 2-chamber filling shoe, the modular impeller filling shoe further comprising a base module in which the filling vaned wheel is present in a first left chamber and the proportioning vaned wheel is present in a second right chamber, wherein the 2-chamber filling shoe has a first modular build-up being mountable to the base module and having a first material inlet which in a mounted state is located above the filling vaned wheel and the 3-chamber filling shoe has a second modular build-up in which the feeding vaned wheel is present inserted into a third center chamber, the second modular build-up being mountable on the base module and having a second material inlet, and wherein the rotary press has a gearbox for driving the vaned wheels which is located external to the modular impeller filling shoe and the vaned wheels are connectible to the gearbox by means of pluggable driving shafts;

b. removing the first modular build-up of the 2-chamber filling shoe comprising a first material inlet;

c. providing the second modular build-up for the 3-chamber filling shoe comprising a second material inlet;

d. inserting the feeding vaned wheel in the third chamber of the second modular build-up;

e. mounting of the second modular build-up on the base module of the modular impeller filling shoe;

f. changing the outlet tube of the material feeding device from the first position to the second position; and g. connecting the feeding vaned wheel to the gearbox using a pluggable drive shaft.

13. A method for converting a 3-chamber filling shoe to a 2-chamber filling shoe, the method comprising:

a. providing a rotary press in combination with a modular impeller filling shoe comprising a modular impeller filling shoe configured to enable a change in function between a 2-chamber filling shoe and a 3-chamber filling shoe, the 2-chamber filling shoe comprising a filling vaned wheel and a proportioning vaned wheel, the 3-chamber filling shoe comprising a filling vaned wheel, a proportioning vaned wheel and a feeding vaned wheel, the modular impeller filling shoe excluding a gearbox for driving the vaned wheels, the modular filling shoe initially configured as a 3-chamber filling shoe, the modular impeller filling shoe further comprising a base module in which the filling vaned wheel is present in a first left chamber and the proportioning vaned wheel is present in a second right chamber, wherein the 2-chamber filling shoe has a first modular build-up being mountable to the base module and having a first material inlet which in a mounted state is located above the filling vaned wheel and the 3-chamber filling shoe has a second modular build-up in which the feeding vaned wheel is present inserted into a third center chamber, the second modular build-up being mountable on the base module and having a second material inlet, and wherein the rotary press has a gearbox for driving the vaned wheels which is located external to the modular impeller filling shoe and the vaned wheels are connectible to the gearbox by means of pluggable driving shafts;

b. disconnecting the drive shaft mounted between the feeding vaned wheel and the gearbox;

c. removing the second modular build-up of the 3-chamber filling shoe comprising the second material inlet and the feeding vaned wheel;

d. providing the first modular build-up comprising a first material inlet;

e. mounting of the first modular build-up on the base module of the modular impeller filling shoe; and f. changing the outlet tube of the material feeding device from the second position to the first position.

14. The modular impeller filling shoe of claim 1, wherein the modular impeller filling shoe has a resilient pressure piece along a rotation on the end of the filling opening to reduce a loss in material.

15. The rotary press according to claim 7, wherein the gearbox for driving the vaned wheels is located on the bottom of a vibrationally decoupled carrier plate of the rotary press.

* * * * *